United States Patent [19]

Kobayashi et al.

[11] Patent Number: 4,874,347

[45] Date of Patent: Oct. 17, 1989

[54] COIN SEPARATOR

[75] Inventors: Osamu Kobayashi, Tsurugashima; Koji Yukimoto, Sakado; Mitsugu Mikami, Kawagoe, all of Japan

[73] Assignee: Kabushiki Kaisha Nippon Conlux, Tokyo, Japan

[21] Appl. No.: 169,246

[22] Filed: Mar. 16, 1988

[30] Foreign Application Priority Data

Mar. 23, 1987 [JP] Japan ..... 62-42293

[51] Int. Cl.[4] ..... G07D 3/02

[52] U.S. Cl. ..... 453/5; 194/338

[58] Field of Search ..... 453/5, 9, 15; 194/334, 194/338

[56] References Cited

U.S. PATENT DOCUMENTS

| | | | |
|---|---|---|---|
| 2,049,170 | 7/1936 | Mills | 194/334 X |
| 2,053,733 | 9/1936 | Nicolaus | 194/338 |
| 4,106,610 | 8/1978 | Heiman | 194/317 |
| 4,220,234 | 9/1980 | Sheltra | 194/338 X |
| 4,286,703 | 9/1981 | Schuller et al. | 194/317 |
| 4,747,478 | 5/1988 | Friedman et al. | 453/5 X |

*Primary Examiner*—F. J. Bartuska

*Attorney, Agent, or Firm*—Diller, Ramik & Wight

[57] ABSTRACT

A coin separator includes first and second coin passages separated and defined in part by a plate having an elongated hole disposed lengthwise in the downward direction of coin movement. The diameter of the elongated hole is less than large diameter coins and greater than smaller diameter coins which are to be sorted. The plate is attachable to and detachable from the casing for cleaning and repair purposes, and a lower portion of the elongated hole has arcuate cutouts on both sides of a lower portion of the plate which projects upwardly in opposite relationship to downward coin movement. The peripheries of the arcuate cutouts and the upwardly projecting plate portion are tapered upwardly in cross-section which in conjunction with a tongue having a lower end movable into and out of the elongated hole assure that bent and/or deflected coins of small diameter pass through the appropriate coin passage.

3 Claims, 5 Drawing Sheets

COIN SEPARATOR

BACKGROUND OF THE INVENTION

The present invention generally relates to a coin selecting apparatus usable for an automatic vending machine, coin exchanger, amusement machine or the like and more particularly to a coin separator for introducing a number of selected coins into a predetermined coin passage in accordance with the kind of coins to be separated.

In general, a coin selecting apparatus includes a primary coin selecting device for discriminating whether a coin inserted through a coin insert slit is a true coin or a false coin and introducing selected true coin and false coin into their predetermined coin passage and a coin separator for introducing the selected true coins into predetermined coin passages in accordance with the kind of coins to be separated.

As a conventional coin separator for separating primarily selected true coins in accordance with the kind of coins, there are known a so-called rail type coin separator which is so constructed that coins adapted to be transferred on an inclned rail are separated in dependence on a difference in diameter of the coins and the separated coins are introduced to predetermined coin passages in accordance with the kind of coins and a coin separator using cradles and carrier arms to introduce coins which fall down, into their predetermined coin passages in accordance with the kind of coins.

It has been heretofore required that the coin selecting apparatus is constructed in smaller dimensions due to the fact that it is accommodated within a limited space in an automatic vending machine or the like. However, the above-described conventional coin separator has a need of arranging in a parallel relation predetermined coin passages through which coins separated in accordance with the kind of coins are introduced in the direction width of the coin selecting apparatus, that is, in the transverse direction relative to the direction of falling of coins from the viewpoint of constructing inclined rails, cradles or carrier arms, in addition to a space required for disposing the inclined rails, cradles or the carrier arms. Thus, a space exclusively required for the coin selector accommodated in the coin selecting apparatus becomes larger and moreover the coin selecting apparatus is unavoidably constructed in larger dimensions. When a space exclusively required for the coin separator becomes large, a space required for arranging other devices to be accommodated in the coin selecting apparatus, for instance, a coin discriminating device for discriminating true coins from false coins is limited. This causes the coin selecting apparatus to be constructed only with much difficulties. Even though it is assumed that the coin selecting apparatus can be constructed, the apparatus itself becomes enlarged. Accordingly, there is a fear that the coin selecting apparatus can not be installed in an automatic vending machine or the like which has a limited space required for installing it. It should be noted that this tendency becomes increasingly remarkable as the number of kinds of coins to be handled in the coin selecting apparatus increases.

SUMMARY OF THE INVENTION

The present invention has been made with the foregoing problems inherent to the conventional coin separator in mind and its object resides in providing a coin separator which requires a small space occupied for installation and is compact in structure.

Another object of the present invention is to provide a coin separator which is constructed in smaller dimensions so as to meet requirements for reducing a space occupied by the coin separator accommodated in a coin selecting apparatus.

To accomplish the above objects, the present invention provides a coin separator comprising first coin guiding means through which a plurality of coins having a different diameter respectively are introduced in the substantially vertical direction, second coin guiding means juxtaposed to the rear surface of the first coin guiding means so as to introduce the coins in the substantially verticl direction, and third coin guiding means for introducing coins having a smaller diameter among a plurality of coins which have been introduced through the first coin guiding means to the second coin guiding means and introducing coins having a larger diameter toward the downstream side of the first coin guiding means. According to the present invention, among a plurality of coins having a different diameter respectively which have fallen down from the upstream side of the first coin guiding means, coins having a larger diameter are introduced toward the downstream side of the first coin guiding means along the direction of falling of the coins without the coins being introduced in the transverse direction relative to the direction of falling of the coins and similarly, coins having a smaller diameter are introduced into the second coin guiding means along the direction of falling of the coins without the coins being introduced in the transverse direction relative to the direction of falling of the coins.

Other objects, features and advantages of the present invention will become readily apparent from a reading of the following description which has been made with reference to the accompanying drawings.

DESCRIPTION OF THE PREFERRED EMBODIMENT

Now, the present invention will be described in a greater detail hereunder with reference to the accompanying drawings which illustrate preferred embodiment thereof.

Figure 1:
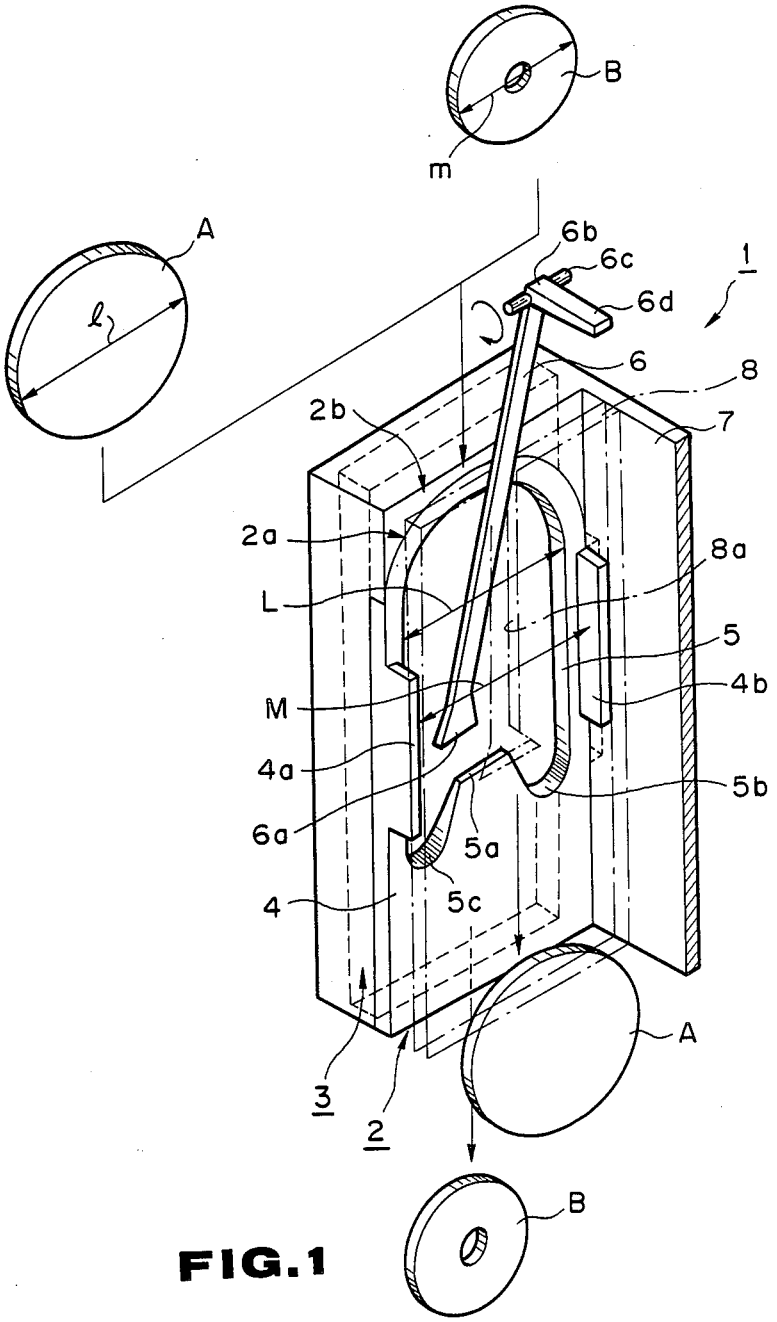
FIG. 1 is a schematic perspective view of a coin separator in accordance with an embodiment of the invention.

FIG. 1 is a schematic perspective view of a coin separator in accordance with an embodiment of the present invention.

A coin separator identified by reference numeral 1 is composed of a first coil passage 2 formed in a direction of vertical falling of coins to serve as first coin guiding means, a second coin passage 3 formed on the rear surface of the first coin passage 2 to serve as second coin guiding means, and third coin guiding means comprising an elongated hole 5 and a tongue 6 to be described later for introducing a coin B having a smaller diameter into the second coin passage 3 serving as second coin guiding means and for introducing a coin A having a larger diameter into an area located downstream of the first coin passage 2 wherein both the coins A and B have passed through the upstream part 2*a* of the first coin passage 2 serving as first coin guiding means.

Incidentally, a coin insert slit 2*b* through which the coin A having a larger diameter and the coin B having a smaller diameter to be separated one from other are inserted is formed on the upstream part 2*a* of the first coin passage 2.

On the other hand, a plate 4 constituting a wall portion defining the first coin passage 2, and the second coin pasage 3 is formed with a vertically extending elongated hole 5 through which the first coin passage 2 is communicated with the second coin passage 3. A width L of the elongated hole 5 is determined less than the diameter L of the coin A having a larger diameter to be separated and appreciably more than the diameter m of the coin B having a smaller diameter to be separated. Further, the elongated hole 5 has arcuate cutouts 5*b* and 5*c* at the lower end 5*a* thereof, and the lower end 5*a* of the elongated hole 5 including the periphery of the cutouts 5*b* and 5*c* is tapered toward the inner periphery of the elongated hole 5 as viewed in a cross-sectional plane to have an increasingly reduced wall thickness. A solid tongue 6 is arranged in the elongated hole 5 is such a manner that a lower end 6*a* enters into the interior of the elongated hole 5. The tongue 6 is turnably supported on a part of a plate 8 to be described later with the aid of shafts 6*c* which are transversely projected from the upper end 6*b*. Further, the tongue 6 is normally urged turnable about the shafts 6*c* in the clockwise direction under the effect of resilient force of a coil spring (not shown) which is engaged with a projection 6*d* projected from the upper end 6*b* in the L-shaped configuration. Incidentally, resilient force of the coil spring is so determined that when the coin A having a larger diameter falls down through the first coin pasage 2, the tongue 6 is turnably displaced away from the first coin passage 2 under the effect of dead weight of the coin A and when the coin B having a smaller diameter falls down through the first coin passage 2, the tongue 6 is not turnably displaced away from the first coin passage even under the effect of dead weight of the coin B.

Figure 2:
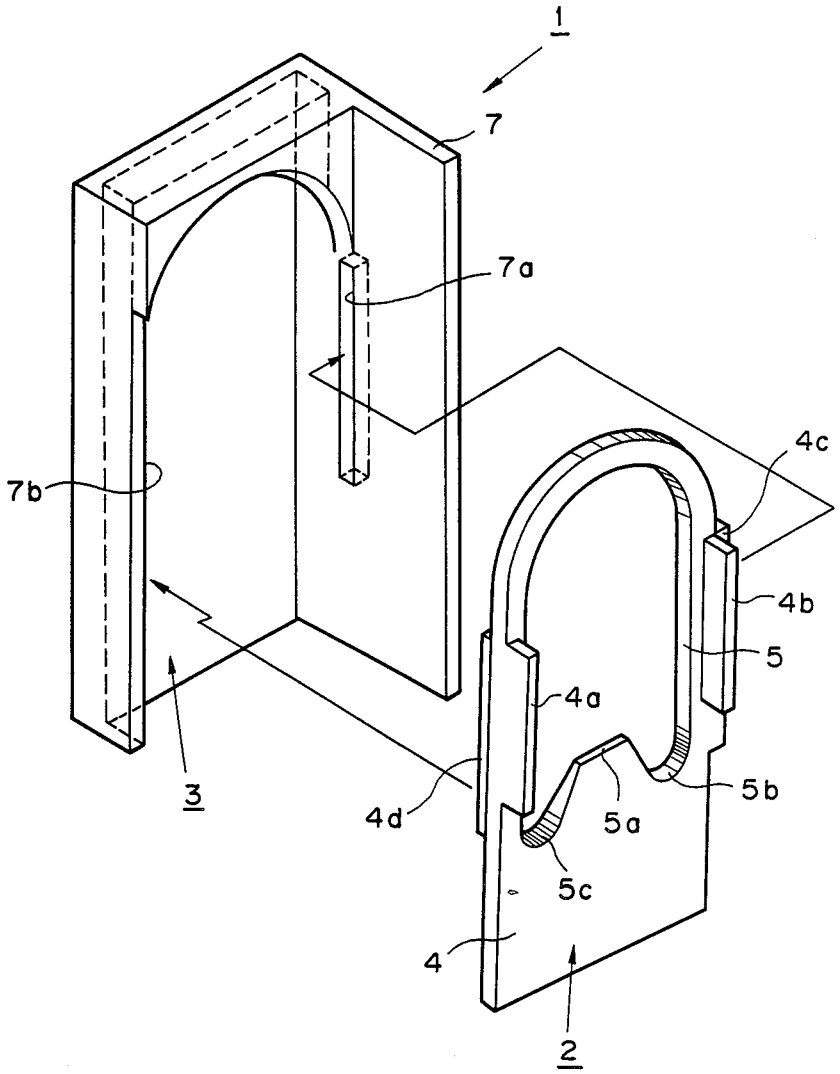
FIG. 2 is a perspective view of the coin separator in FIG. 1 shown in a disassembled state.

In FIG. 1, reference numeral 7 designates a casing for forming the second coin passage 3 and reference numeral 8 designates a wall portion exposed to the first coin passage 2. The plate 8 is formed with a cutout 8*a* through which the tongue 6 is turnably displaced. Further, in FIG. 1, reference numerals 4*a* and 4*b* designate a side wall respectively which serves to define a width of the first coin passage 2. A width M of the first coin pasage 2 as defined between both the side walls 4*a* and 4*b* is determined appreciably wider than the diameter l of the coin A having a larger diameter. As shown in FIG. 2 which is a perspective view of the coin separator shown in a disassembled state, the plate 4 constituting the rear surface of the first coin passage 2 is provided attachable to and detachable from the casing 7 constituting the second coin passage 3 and it is correctly positioned relative to the casing 7 and supported by the latter by fitting a projection 4*c* projected sidewards of the plate 4 into a recess 7*a* formed on the inner wall of the casing 7 in such a manner as represented by an arrow mark and moreover fitting a projection 4*d* projected from the lower part of the plate 4 at one side end thereof to the inner face 7*b* of the casing 7 in such a manner as represented by an arrow mark.

Next, function of the coin separator 1 as constructed in the above-described manner will be described below and moreover a structure of the same will be described below in more details.

Figure 3:
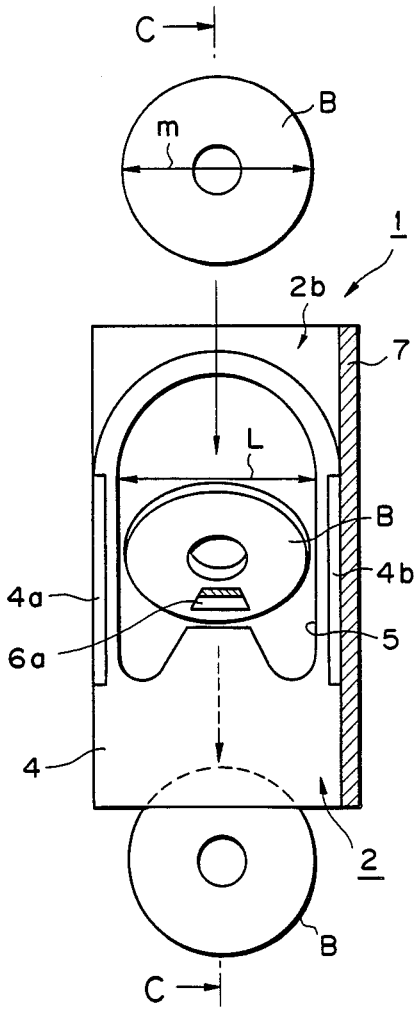
FIG. 3 is an illustrative view of the coin separator illustrating a function of the coin separator of the invention, particularly a function of separating a coin having a smaller diameter.

A group of coins are primarily separated with the use of a primary coin selecting unit accommodated in a coin selecting apparatus which is not shown in the drawings so that true coins are selected from false coins. Among the coins which have been selected as true coin, a coin A having a larger diameter and a coin B having a smaller diameter, as shown in FIG. 1, are inserted through the coin insert slit 2*b* to fall down in the coin separator 1. In a case where the coin which has fallen down through the coin insert slit 2*b* is a coin B having a smaller diameter, the direction of movement of the coin B is changed toward the rear surface side of the first coin passage 2 from the vertical direction of the latter under the effect of thrusting force of the tongue 6, as shown in FIG. 3 which is a front view of the coin separator in FIG. 1 and FIG. 4 which is a sectional view of the same taken in line C—C in FIG. 3, because the diameter m of the coin B having a smaller diameter is smaller than the width L of the elongated hole 5. Thus, the coin B having a smaller diameter is introduced into the second coin passage 3 throuth the elongated hole 5 and it is then received in a coin collecting box allocated to the coin B (not shown) placed downwardly of the second coin passage 3.

Figure 5:
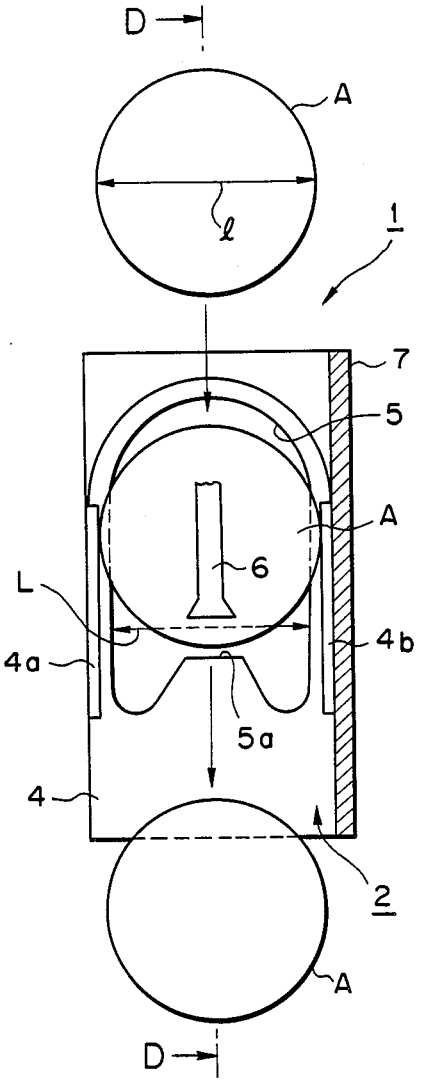
FIG. 5 is an illustrative view of the coin separator illustrating a function of the coin separator of the invention, particularly a function of separating a coin having a larger diameter.
Figure 6:
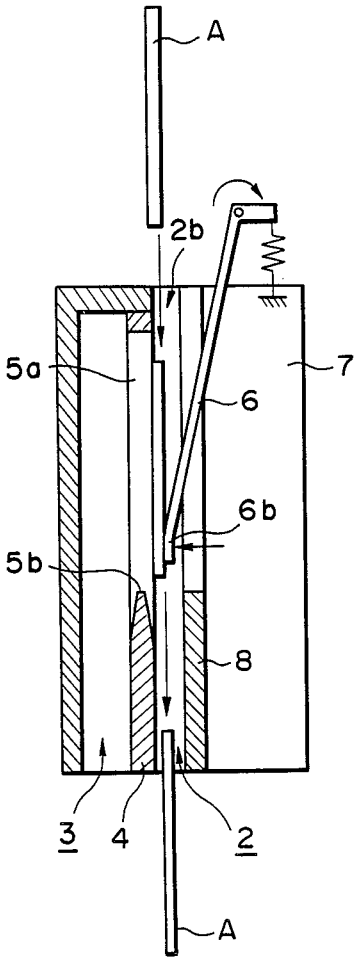
FIG. 6 is a sectional view of the coin separator taken in line D—D in FIG. 5.

On the other hand, in a case where the coin which has fallen through the coin insert slit 2*b* of the coin separator 1 is a coin A having a larger diameter, it is not introduced through the elongated hole 5 irrespective of how it is thrusted toward the rear surface side of the first coin passage 2 by means of the tongue 6, as shown in FIG. 5 which is a front view of the coin separator in FIG. 1 and FIG. 6 which a sectional view of the same taken in line D—D in FIG. 5, because the diameter l of the coin A having a larger diameter is larger than the width L of the elongated hole 5. Thus, the coin A having a larger diameter is introduced in the vertical direction under the effect of its dead weight against thrusting force of the tongue 6, that is to say, it is introduced into the downstream side of the first coin passage 2 and it is then received in a coin collecting box allocated to the coin A (not shown) placed downwardly of the first coin passage 2.

Figure 4:
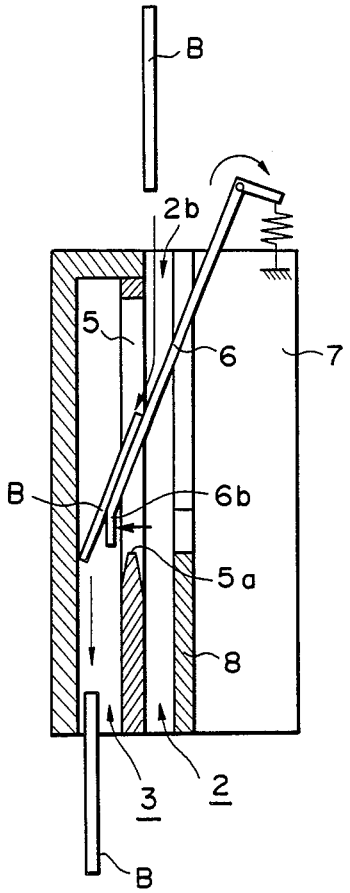
FIG. 4 is a sectional view of the coin separator taken in line C—C in FIG. 3.

Incidentally, as shown in FIGS. 4 and 6, the lower end part 5*a* of the elongated hole 5 formed on the plate 4 is tapered upwardly. Thus, regardless of the fact that the coins A and B are deformed to some extent or they fall down through the first coin passage 2 while assuming an inclined posture, the periphery of the coins A and B is caused to collide against the tapered lower end part 5*a* of the elongated hole 5 whereby they are smoothly separated on from, other and they are then introduced toward the downstream side of the first and second coin passages 2 and 3 without any hindrance of their downward movement.

Figure 7:
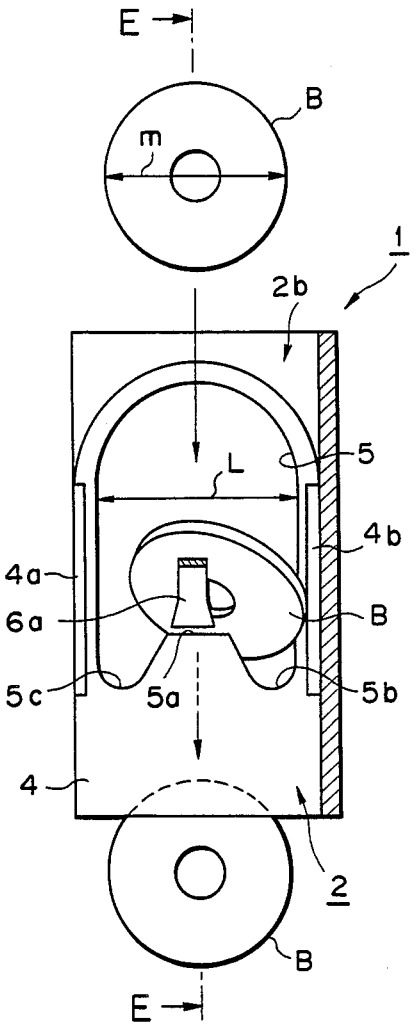
FIG. 7 is an illustrative view of the coin separator illustrating a function of the coin separator of the invention, particularly a function of separating a coin which has fallen in an inclined posture.
Figure 8:
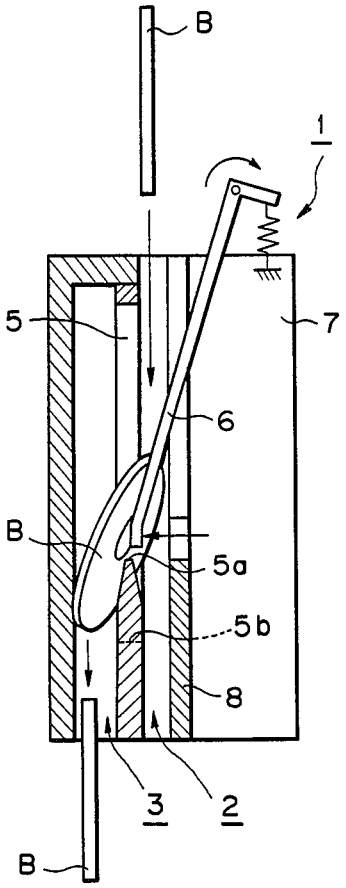
FIG. 8 is a sectional view of the coin separator taken in line E—E in FIG. 7.

Further, even in a case where only one half of the coin B having a smaller diameter is inserted through the elongated hole 5 but the other half of the same is projected toward one end 4*b* of the first coin passage 2, as shown in FIG. 7 which is a front view of the coin separator in FIG. 1 and FIG. 8 which is a sectional view of the coin separator taken in line E—E in FIG. 7, the coin B having a smaller diameter is engaged to the cutout 5*b* of the lower end part 5*a* of the elongated hole 5 and thereby it is affected by a force which is oriented toward the second coin passage 3 owing to a combination of the dead weight of the coin B with a reaction force caused by engagement of the coin B to the cutout 5*b* under the effect of its deadweight. Thus, the coin B is delivered to the second coin passage 3 even though it has fallen down in the above-mentioned state, and separation of the coin B is achieved with an excellently high accuracy.

Incidentally, in the above-described embodiment, the tongue 6 for thrusting the coins is constructed in a solid structure and it is turned under the effect of resilient force of a spring. However, the present invention should not be limited only to this. Alternatively, the tongue may be constructed merely by a leaf spring or the like resilient means.

Further, the coin separator of the invention has been described above with respect to a case where coins A having a larger diameter and coins B having a smaller diameter are separated one from other. However, the present invention should not be limited only to this. After all, the present invention may be applied to any type of coin separator in which two kinds of coins having a different diameter respectively are separated one from other.

In the above-described embodiment, the coin separator is so constructed that two kinds of coins having a different diameter respectively are separated one from other. Thus, if a plurality of the coin separators of the invention are connected to one another in the vertical direction, it is of course possible to correctly separate more than two kinds of coins one from another.

As is apparent from the above description, the coin separator of the invention is so constructed that second coin guiding means through which coins are introduced downwardly is juxtaposed to the rear surface of first coin guiding means through which coins are introduced downwardly and a coin to be separated is correctly introduced into the first coin guiding means or the second coin guiding means with the aid of third coin guiding means comprising an elongated hole and a tongue adapted to enter into the elongated hole. Thus, the coin separator of the invention is constructed in a compact structure compared with a typical conventional coin separator including inclined rails, cradles, carrier arms or the like member arranged in a parallel relation in the transverse direction at a right angle relative to the direction of falling of coins. This causes a space exclusively required for the coin separator accommodated in a coin selecting apparatus to be reduced remarkably. Accordingly, the present invention can provide a small type coin selecting apparatus.

The present invention may be practiced in various manners without departure from the spirit and essential features thereof. Accordingly, the foregoing embodiment is merely illustrative but not limiting in all respects. The scope of the present invention is as defined by the appended claims without any restriction made by description in the specification. It will of course be readily understood by any expert in the art that all changes or modifications made within the scope of the invention fall under the scope of the invention.

What is claimed is:

1. A separator comprising:

a first coin passage through which a plurality of coins having different diameters are introduced in a substantially downward moving direction;

said first coin passage having a rear surface;

a second coin passage formed in part by a casing juxtaposed to the rear surface of said first coin passage so as to move selected coins in a substantially downward moving direction;

a plate disposed between and in part defining said first and second coin passages;

said plate being attached to and detachable from said casing;

an elongated hole formed in said plate and disposed lengthwise in the direction of downward coin movement, the diameter of said elongated hole being less than large diameter coins among a plurality of coins and greater than small diameter coins among a plurality of coins which move downwardly relative to said first coin passage, said elongated hole being formed with arcuate cutouts on both sides of a lower upwardly projecting portion of said plate, said arcuate cutouts open in opposite upward relationship to the downward direction of coin movement, said upwardly projecting plate portion and a periphery of said arcuate cutouts tapering upwardly in cross-section so as to form an upwardly decreasing wall thickness; and a tongue having a lower end adapted for entry into said elongated hole so as to allow the coins which have moved downwardly from the upstream side of said first coin passage to be urged toward said elongated hole with smaller diameter coins passing through said elongated hole into said second coin passage and large diameter coins moving said tongue out of said elongated hole to pass downwardly in said first coin passage.

2. The coin separator of claim 1 wherein said tongue is a solid structure having an upper end including shaft means for pivotally supporting said tongue, and said tongue lower end is adapted for entry into said elongated hole under the effect of a resilient force of a spring acting against said tongue upper end.

3. The coin separator of claim 1 wherein said tongue is constructed as a resilient leaf spring.

* * * * *